US011432595B1

(12) United States Patent
Wan

(10) Patent No.: US 11,432,595 B1
(45) Date of Patent: Sep. 6, 2022

(54) CUP, MOLD AND UNDERWEAR

(71) Applicant: Grand Gain Industrial Limited, Hongkong (CN)

(72) Inventor: Ho Yau Wan, Hongkong (CN)

(73) Assignee: Grand Gain Industrial Limited, Hong Kong (CN)

( * ) Notice: Subject to any disclaimer, the term of this patent is extended or adjusted under 35 U.S.C. 154(b) by 0 days.

(21) Appl. No.: 17/531,377

(22) Filed: Nov. 19, 2021

(51) Int. Cl.
*A41C 3/00* (2006.01)

(52) U.S. Cl.
CPC ..... *A41C 3/0092* (2013.01)

(58) Field of Classification Search
CPC ..... A41C 3/0092; A41C 3/14; A41C 3/142; A41C 3/148; A41C 3/10
USPC ..... 450/39, 54–57
See application file for complete search history.

(56) References Cited

U.S. PATENT DOCUMENTS 2,727,278 A * 12/1955 Thompson ..... B29C 44/1209 264/46.7
4,308,869 A * 1/1982 Boyen ..... A41C 3/148 450/38
4,557,267 A * 12/1985 Cole ..... A41C 5/005 450/40
6,881,123 B1 * 4/2005 Klakauskas ..... A41C 3/10 450/39
7,727,048 B2 * 6/2010 Gransberry ..... A41C 3/144 450/39
7,815,488 B2 * 10/2010 Gransberry ..... A41C 3/10 450/39
7,988,526 B2 * 8/2011 Gransberry ..... A41C 3/144 450/39
8,142,256 B2 * 3/2012 Rose ..... A41C 3/10 450/39
9,456,638 B2 * 10/2016 Abbott ..... A41C 3/10
9,788,579 B2 * 10/2017 Miller ..... A41C 3/0085
10,334,891 B2 * 7/2019 Weber-Unger ..... A41C 3/12
10,568,366 B1 * 2/2020 Cavosie ..... A41C 3/144
2003/0181129 A1 * 9/2003 Getman ..... A41C 3/0057 450/57
2003/0220048 A1 * 11/2003 Toro ..... A61F 13/141 450/57
2004/0111781 A1 * 6/2004 Miyake ..... D04B 21/207 2/69
2005/0037689 A1 * 2/2005 Gorski ..... A41C 3/065 450/81
2005/0208874 A1 * 9/2005 Lau ..... A41C 3/10 450/39
2005/0208875 A1 * 9/2005 Jagaric ..... A41C 3/144 450/39

(Continued)

*Primary Examiner* — Gloria M Hale
(74) *Attorney, Agent, or Firm* — Tucker Ellis LLP; Heather M. Barnes

(57) ABSTRACT

A cup, a mold and an underwear are disclosed. The cup includes an upper surface layer, a lower surface layer and a nipple-exposure prevention layer. The upper surface layer is provided with an inner concave portion, the nipple-exposure prevention layer is arranged in the inner concave portion, and the upper surface layer is arranged towards a side far away from a breast. When the lower surface layer of the cup is closely attached to the upper surface layer, and the lower surface layer is contacted with a nipple, the nipple-exposure prevention layer is capable of preventing a nipple on a female breast from being prominent.

12 Claims, 6 Drawing Sheets

(56) References Cited

U.S. PATENT DOCUMENTS

2005/0255789 A1* 11/2005 Gaudet ..... A41C 3/0085 450/41
2006/0030238 A1* 2/2006 Jagaric ..... A41C 3/144 450/57
2008/0045122 A1* 2/2008 Utaka ..... A44B 13/00 450/25
2008/0125012 A1* 5/2008 Gransberry ..... A41C 3/144 450/64
2008/0176485 A1* 7/2008 Linkon ..... A41C 3/10 450/57
2008/0194180 A1* 8/2008 Warren ..... B29C 65/086 450/86
2009/0130953 A1* 5/2009 Gransberry ..... A41C 3/144 450/39
2009/0181599 A1* 7/2009 Farmer ..... A41B 9/001 450/86
2009/0298386 A1* 12/2009 Deal ..... A41C 3/065 450/92
2010/0022163 A1* 1/2010 Widell ..... A41C 3/144 450/39
2010/0041313 A1* 2/2010 Castellano ..... A41C 3/144 450/86
2010/0255755 A1* 10/2010 Rose ..... A41C 3/10 450/55
2012/0149278 A1* 6/2012 Liu ..... A41C 3/144 450/57
2013/0316615 A1* 11/2013 Hurd ..... A41D 31/125 264/45.3
2014/0073221 A1* 3/2014 Liu ..... A41C 3/12 450/39
2014/0273738 A1* 9/2014 Raven ..... A41C 3/144 450/92
2015/0024658 A1* 1/2015 Abbott ..... A41C 3/14 450/39
2017/0325517 A1* 11/2017 Brownell ..... A41C 3/144
2018/0334763 A1* 11/2018 Liguori ..... G21F 1/10
2020/0022423 A1* 1/2020 Webster ..... A41C 3/144
2020/0085113 A1* 3/2020 Rendone ..... A41C 3/10

* cited by examiner

CUP, MOLD AND UNDERWEAR

TECHNICAL FIELD

The present application relates to the technical field of female clothing, and more particularly, to a cup, a mold and an underwear.

BACKGROUND

Cups are the main components of a bra and other female underwear, with a main function of protecting, supporting and decorating the breast of a wearer, so that the wearer shows an appearance of perfect female body shape curve. The existing cup is becoming thinner and thinner, and the nipple on a female breast is prominent due to the thin or excessively elastic fabric, especially in summer, thus causing inconvenience.

SUMMARY

Implementations of the present application provide a cup, a mold and an underwear, which can prevent a nipple on a female breast from being prominent.

According to a first aspect of the present application, a cup is provided, which includes an upper surface layer, a lower surface layer and a nipple-exposure prevention layer. The upper surface layer is provided with an inner concave portion, the nipple-exposure prevention layer is arranged in the inner concave portion, and the upper surface layer is arranged towards a side far away from a breast. When the lower surface layer is closely attached to the upper surface layer, and the lower surface layer is contacted with a nipple, the nipple-exposure prevention layer is capable of preventing the nipple from being prominent.

According to a second aspect of the present application, a mold is provided, which is used for manufacturing the cup described above, and includes a first male die and a female die. The first male die includes a first protruding portion, and the first protruding portion is provided with a second bulge portion. The female die includes a recess portion, the recess portion includes a second depressed portion, the second bulge portion is matched with the second depressed portion when the first male die is completely embedded into the female die, and the upper surface layer of the cup is formed through the first male die and the female die.

According to a third aspect of the present application, an underwear is provided, which includes two cups described above which are symmetrically arranged, a side wing, a center front and a back wing. The side wing is connected with a side edge of the cup, and the back wing is connected with an edge of the side wing; and the center front is arranged between the two cups.

The cup of the present application includes the upper surface layer, the lower surface layer and the nipple-exposure prevention layer, the upper surface layer is provided with the inner concave portion, the nipple-exposure prevention layer is arranged in the inner concave portion, and the upper surface layer is arranged towards the side far away from the breast; and when the lower surface layer is closely attached to the upper surface layer, and the lower surface layer is contacted with the nipple, the nipple-exposure prevention layer can prevent a nipple on a female breast from being prominent.

Other features and advantages of the present application will be stated in the following specification, and are partially apparent from the specification, or are learned by implementing the present application. The objectives and other advantages of the present application may be implemented and obtained by the structure particularly pointed out in the specification, the claims and the drawings.

REFERENCE NUMERALS

Figure 1:
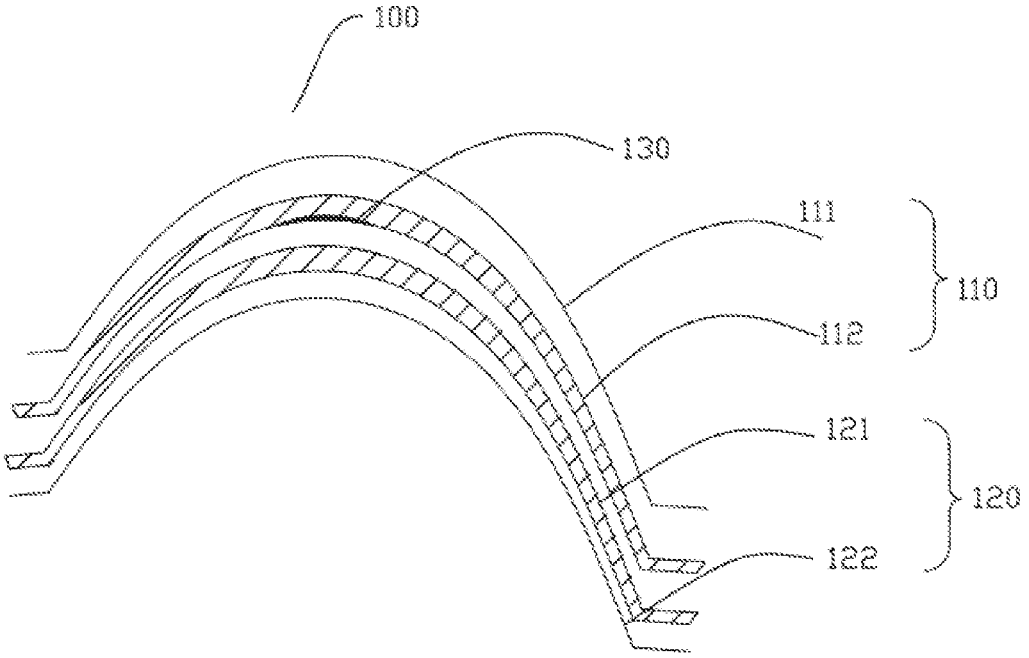
FIG. 1 is a schematic structural diagram of a cup in an embodiment of the present application.

100 refers to cup; 110 refers to upper surface layer; 120 refers to lower surface layer; 130 refers to nipple-exposure prevention layer; 140 refers to inner concave portion; 111 refers to first upper surface layer; 112 refers to second upper surface layer; 121 refers to first lower surface layer; 122 refers to second lower surface layer; 150 refers to outer convex portion; 160 refers to second cavity; 131 refers to first extension section; 132 refers to second extension section; 141 refers to first bulge portion; 133 refers to first depressed portion; 134 refers to first surface; 135 refers to second surface;

200 refers to mold; 210 refers to first male die; 220 refers to female die; 211 refers to first protruding portion; 212 refers to second bulge portion; 221 refers to recess portion; 222 refers to second depressed portion; 230 refers to second male die; 231 refers to second protruding portion; 240 refers to third male die; 241 refers to third protruding portion; 242 refers to third bulge portion; 260 refers to notch; and

300 refers to side wing; 400 refers to center front; and 500 refers to back wing.

DETAILED DESCRIPTION

To make the objectives, the technical solutions, and the advantages of the present application clearer, the present application is further described in detail hereinafter with reference to the accompanying drawings and the implementations. It shall be understood that the specific implementations described herein are only used for explaining the present application and are not intended to limit the present application. The implementations in the present application and the features in the implementations may be combined with each other at will without conflict.

The terms "first", "second", etc. in the specification, the claims, and the accompanying drawings above are used to distinguish similar objects, and are not necessarily used to describe a specific order or sequence.

In the description of the present application, it shall be noted that the terms "installation", "connected" and "connection" if any shall be understood in a broad sense unless otherwise specified and defined. For example, they may be fixed connection, removable connection or integrated connection; and may be direct connection, or indirect connection through an intermediate medium, and communication inside two elements. The specific meanings of the above terms in the present application may be understood in a specific case by those of ordinary skills in the art.

The existing cup is becoming thinner and thinner, but due to a thin or excessively elastic fabric, the nipple on a female breast is prominent, especially in summer, thus causing inconvenience.

In order to solve the related technical problem, an embodiment of the present application provides a cup 100, and the cup 100 in the embodiment of the present application can prevent nipple-exposure of a female breast.

The cup 100 in the first embodiment of the present application is described with reference to FIG. 1 to FIG. 6.

The cup 100 in the embodiment of the present application includes an upper surface layer 110, a lower surface layer 120 and a nipple-exposure prevention layer 130. The upper surface layer 110 is provided with an inner concave portion 140, the nipple-exposure prevention layer 130 is arranged in the inner concave portion 140, and the upper surface layer 110 is arranged towards a side far away from a breast. When the lower surface layer 120 of the cup 100 is closely attached to the upper surface layer 110, and the lower surface layer 120 is contacted with a nipple, the nipple-exposure prevention layer 130 is capable of preventing a nipple on a female breast from being prominent.

Figure 2:
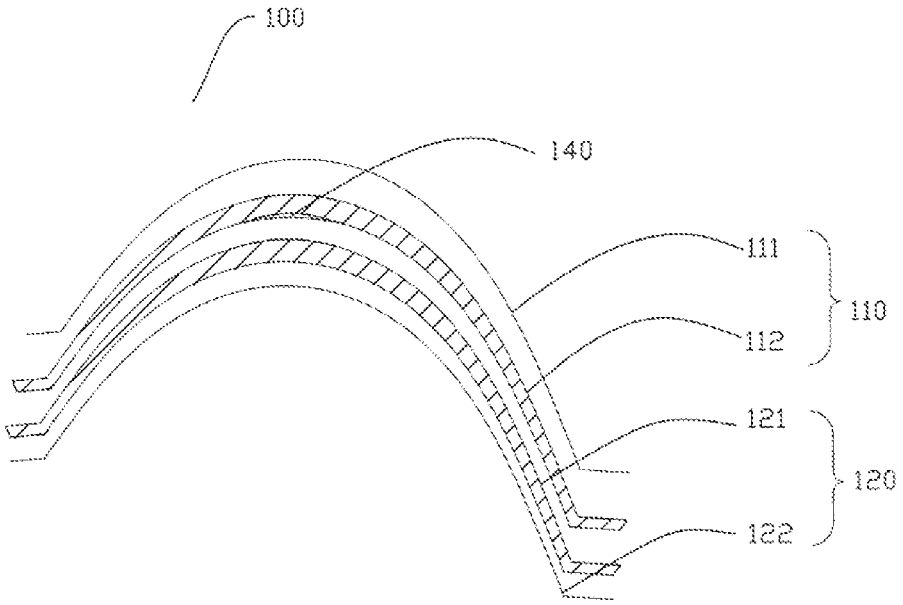
FIG. 2 is a schematic structural diagram of the cup without a nipple-exposure prevention layer in an embodiment of the present application.
Figure 3:
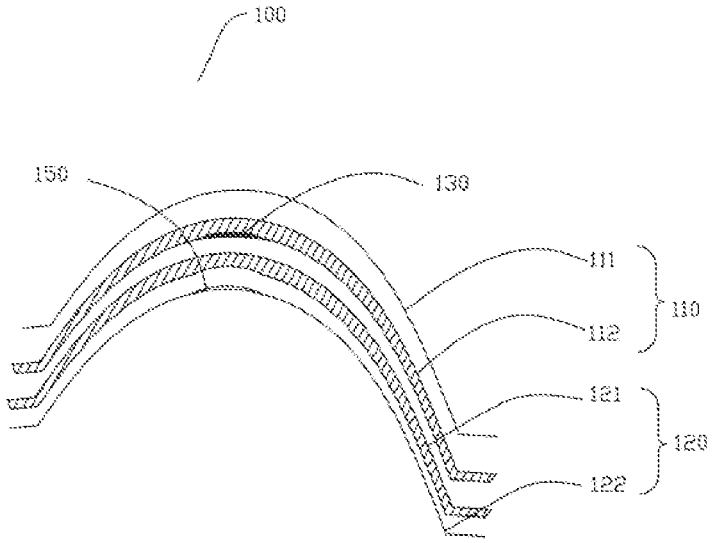
FIG. 3 is a schematic structural diagram of the cup in an embodiment of the present application.
Figure 4:
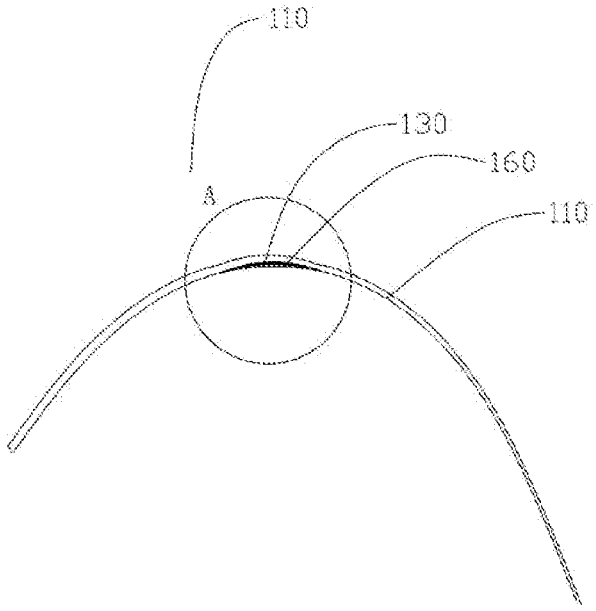
FIG. 4 is a schematic structural diagram of the cup in an embodiment of the present application.
Figure 5:
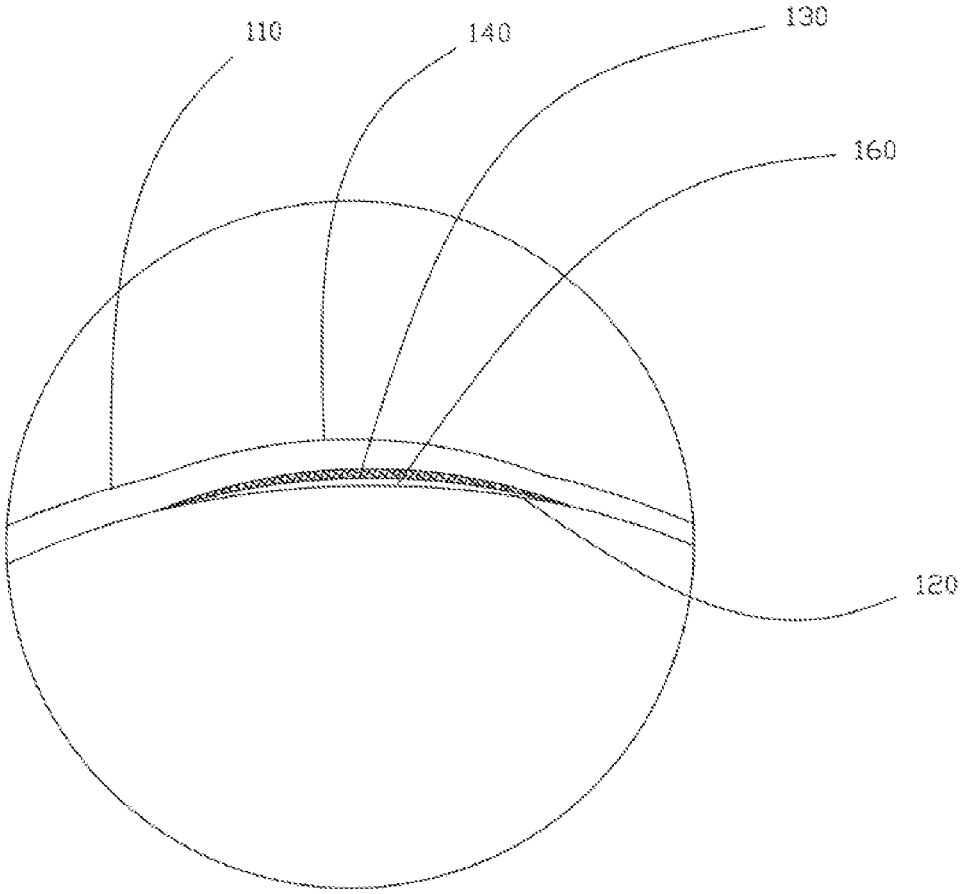
FIG. 5 is a locally enlarged view of part A in FIG. 4.
Figure 6:
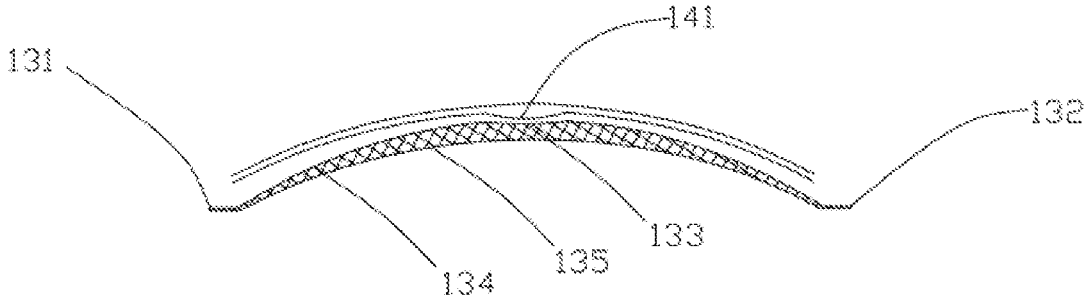
FIG. 6 is a schematic structural diagram of a cup in an embodiment of the present application.
Figure 7:
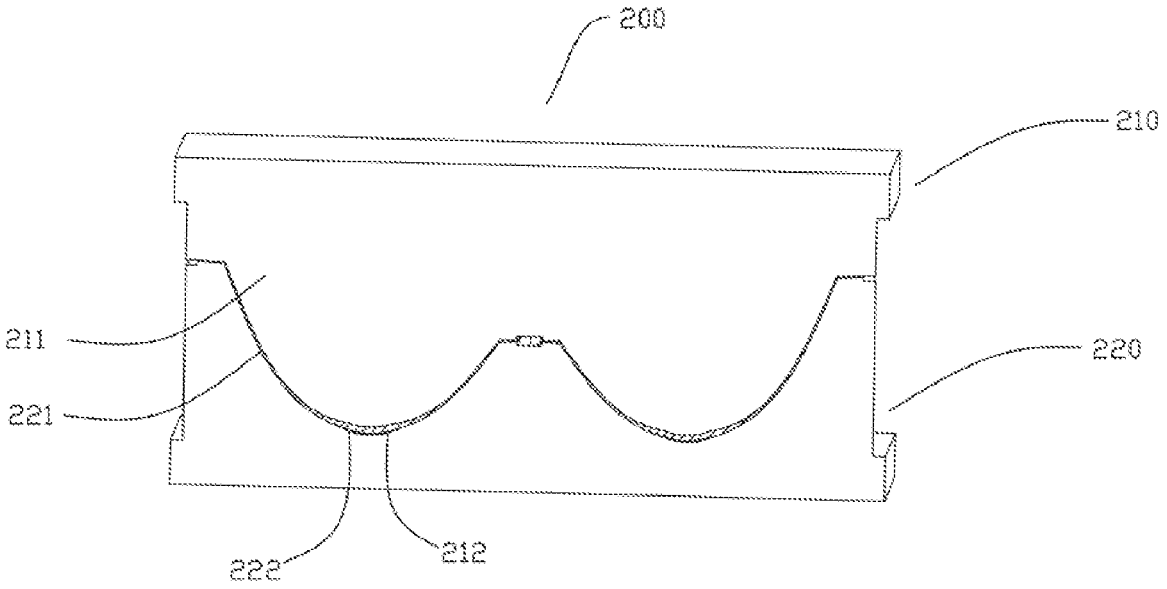
FIG. 7 is a schematic structural diagram of a mold of the cup in an embodiment of the present application.
Figure 8:
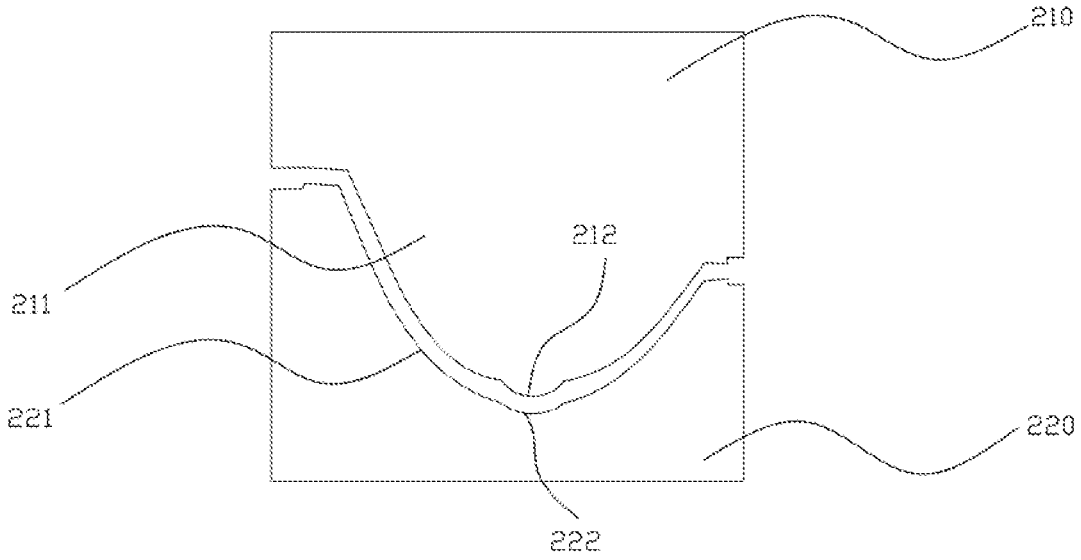
FIG. 8 is a cross-section view of a first male die and a female die in FIG. 7.
Figure 9:
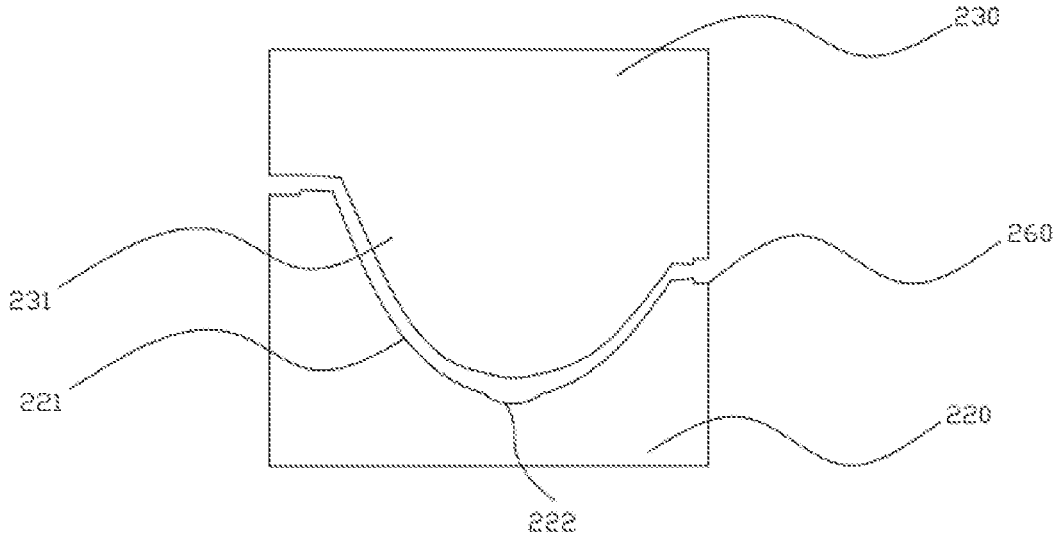
FIG. 9 is a cross-section view of a second male die and the female die in an embodiment of the present application.
Figure 10:
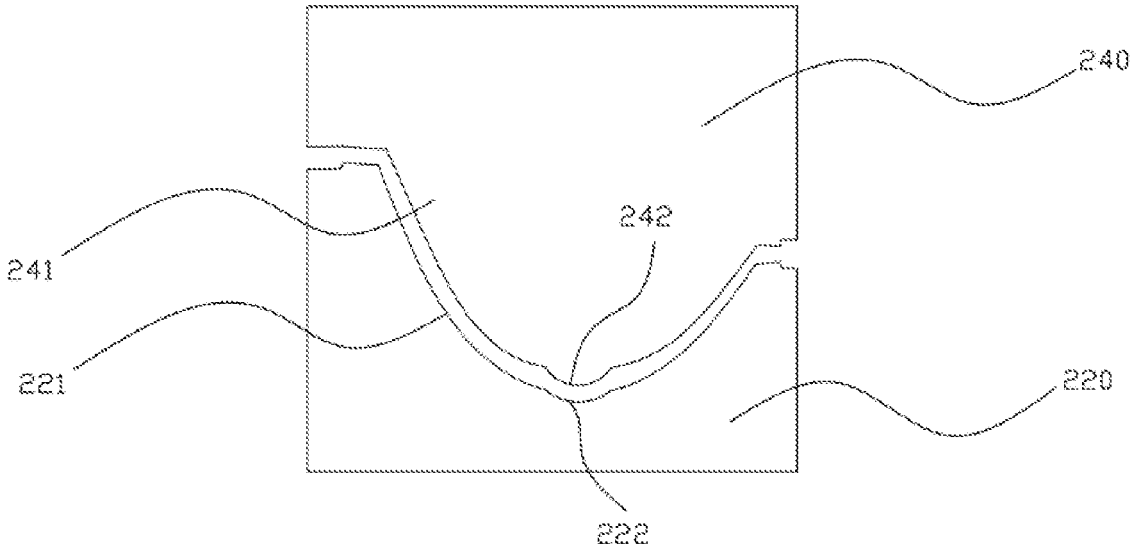
FIG. 10 is a cross-section view of a third male die and the female die in an embodiment of the present application.
Figure 11:
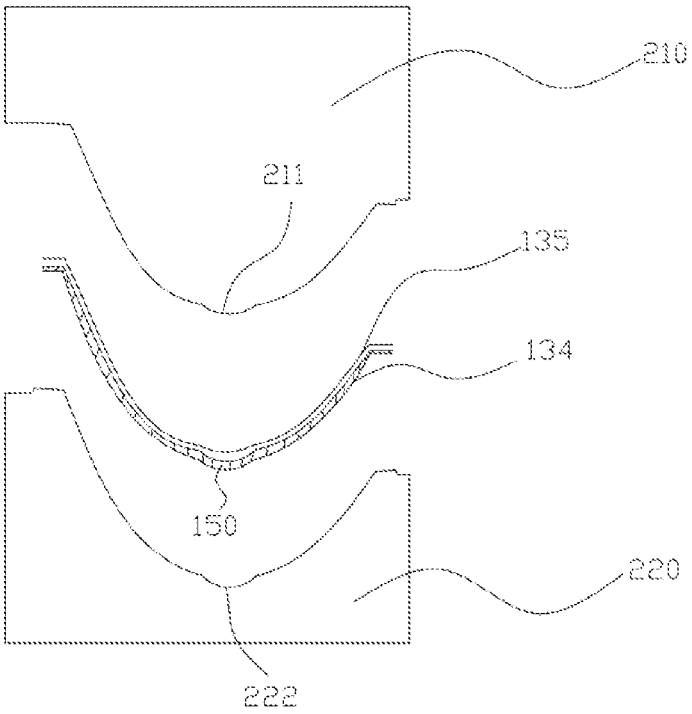
FIG. 11 is a schematic diagram of preparation of an upper surface layer in an embodiment of the present application.

The upper surface layer 110 may be a single-layer structure or a double-layer structure. FIG. 1 to FIG. 3 show a structure of the cup with the upper surface layer 110 of the double-layer structure, and FIG. 4 to FIG. 6 show a structure of the cup with the upper surface layer 110 of the single-layer structure. With reference to FIG. 1 to FIG. 3, the upper surface layer 110 according to the embodiment includes a first upper surface layer 111 and a second upper surface layer 112, and the lower surface layer according to the embodiment includes a first lower surface layer 121 and a second lower surface layer 122.

The lower surface layer 120 and the upper surface layer 110 may be attached to each other by hot pressing.

In some implementations, after the upper surface layer 110 and the lower surface layer 120 are hot-pressed, the nipple-exposure prevention layer 130 is closely attached to the lower surface layer 120. Specifically, the nipple-exposure prevention layer 130 is arc-shaped, and includes a first surface 134 and a second surface 135. After the upper surface layer 110 and the lower surface layer 120 are hot-pressed, the second surface 135 of the nipple-exposure prevention layer may be closely attached to the lower surface layer 120.

In some implementations, the nipple-exposure prevention layer 130 is partially and closely attached to the lower surface layer 120, and a first cavity is formed between the nipple-exposure prevention layer 130 and the lower surface layer 120. Specifically, the nipple-exposure prevention layer 130 is arc-shaped, and includes a first surface 134 and a second surface 135. After the upper surface layer 110 and the lower surface layer 120 are hot-pressed, the first cavity may be formed between the second surface 135 of the nipple-exposure prevention layer 130 and the lower surface layer 120, thus forming a certain buffer space, increasing comfort of a female, and further preventing the nipple on the female breast from being prominent.

In some implementations, the lower surface layer 120 of the cup is provided with an outer convex portion 150, and the outer convex portion 150 protrudes in a direction towards the nipple-exposure prevention layer 130. When a radian of the outer convex portion 150 is not greater than that of the nipple-exposure prevention layer 130, after the nipple-exposure prevention layer 130 and the lower surface layer 120 are hot-pressed, the second surface 135 of the nipple-exposure prevention layer 130 is closely attached to a surface of the outer convex portion 150.

In some implementations, when a radian of the outer convex portion 150 is greater than that of the nipple-exposure prevention layer 130, after the nipple-exposure prevention layer 130 and the lower surface layer 120 are hot-pressed, the second surface 135 of the nipple-exposure prevention layer 130 will not be completely attached to the outer convex portion 150 of the lower surface layer 120. Therefore, a second cavity 160 is formed between the second surface 135 of the nipple-exposure prevention layer 130 and the outer convex portion 150 of the lower surface layer 120, and the second cavity 160 can further prevent the nipple on a female breast from being prominent, thus strengthening protection for the female breast, and increasing wearing comfort of a female at the same time. Moreover, the outer convex portion 150 arranged on the lower surface layer 120 is capable of well accommodating the nipple of a female, and preventing a nipple position from shifting after the female wears the cup, which will cause deformation of the female nipple and affect aesthetic appearance.

In some implementations, the nipple-exposure prevention layer 130 includes a first extension section 131 and a second extension section 132. The first extension section 131 is respectively arranged around the cup. When the nipple-exposure prevention layer 130 and the upper surface layer 110 of the cup are bonded by hot pressing, the nipple-exposure prevention layer 130 is arranged in the inner concave portion 140 of the upper surface layer 110. The first extension section 131 and the second extension section 132 of the nipple-exposure prevention layer 130 are respectively placed on the upper surface layer 110. It should be understood that, the first extension section 131 and the second extension section 132 of the nipple-exposure prevention layer 130 are overlapped on the upper surface layer 110, and a third cavity may be formed between the upper surface layer 110 and the nipple-exposure prevention layer 130. The first extension section 131 and the second extension section 132 of the nipple-exposure prevention layer 130 can ensure that the nipple-exposure prevention layer 130 will not shift when the nipple-exposure prevention layer 130 and the upper surface layer 110 are hot-pressed, thus improving the hot pressing effect. Meanwhile, the third cavity can provide a certain buffer space for the nipple-exposure prevention layer 130, thus further preventing a nipple position on a female breast from being prominent.

In some implementations, the nipple-exposure prevention layer 130 may be circumferentially provided with a cycle of extension section, which can further avoid the nipple-exposure prevention layer 130 from shifting during hot pressing.

In some implementations, adhesives are arranged between the first extension section 131 and the upper surface layer 110 and between the second extension section 132 and the upper surface layer 110, and the first extension section 131 and the second extension section 132 are adhered to the upper surface layer 110 through the adhesives, thus further preventing the nipple-exposure prevention layer 130 from shifting during hot pressing. The adhesives may be arranged on the first extension section 131 and the second extension section 132, or on parts of the upper surface layer 110 of the cup 100 where the first extension section 131 and the second extension section 132 are bonded by hot pressing.

In some implementations, the upper surface layer 110 is provided with a first groove and a second groove. The first extension section 131 and the second extension section 132 may be respectively arranged in the first groove and the second groove, and then are pressed with the upper surface layer 110, thus further preventing the nipple-exposure prevention layer 130 from shifting during hot pressing. The first groove and the second groove may be formed at positions corresponding to the first extension section 131 and the second extension section 132 on a surface of the upper surface layer 110, or may be arranged on an inner wall of the upper surface layer 110 in a hole-like manner. The first extension section 131 and the second extension section 132 are inserted into the first hole-like groove and the second hole-like groove respectively.

In some implementations, the inner concave portion 140 of the cup is provided with a first bulge portion 141, the nipple-exposure prevention layer 130 is provided with a first depressed portion 133, and the first depressed portion 133 corresponds to the first bulge portion 141, so that when the nipple-exposure prevention layer 130 and the upper surface layer 110 are hot-pressed, the nipple-exposure prevention layer 130 is arranged in the inner concave portion 140 of cup 100, and the first bulge portion 141 of the inner concave portion 140 is matched with the first depressed portion 133 of the nipple-exposure prevention layer 130, thus further preventing the nipple-exposure prevention layer 130 from shifting during hot pressing with the upper surface layer 110.

The nipple-exposure prevention layer 130 may be a capsule or a nipple sticker. In some implementations, the nipple-exposure prevention layer 130 is a capsule, and the capsule may be filled with gas or liquid. Before preparing the capsule, liquid or air may be filled into the capsule, so as to prevent nipple-exposure of a female. In addition, the capsule can effectively shape a plump breast, thus improving aesthetic appearance after wearing the cup. Filling the liquid into the capsule can play a role of reducing a temperature, thus improving comfort of a female wearing the cup.

In some implementations, the nipple-exposure prevention layer 130 is a nipple sticker, and the nipple sticker has at least one layer, or may be single-layered, double-layered and even multiple-layered. Moreover, the nipple sticker is composed of at least one of superfine fiber cotton, soft sponge, thermoplastic polyurethane elastomer rubber, thermoplastic rubber, polyamide, silicone plastic or rubber-plastic foaming material.

In some implementations, the nipple sticker has three layers, including an outer layer, a middle layer and an inner layer. The outer layer is made of a superfine absorbent knitted fabric, the middle layer is made of a superfine fiber cotton or a soft sponge, and the inner layer is made of a superfine absorbent knitted fabric.

With reference to FIG. 7 to FIG. 11, a mold 200 in a second embodiment of the present application is described hereinafter.

The mold 200 of the cup is used for manufacturing the cup 100 in the first embodiment above, and includes a first male die 210 and a female die 220, wherein the first male die 210 includes a first protruding portion 211, the first protruding portion 211 is provided with a second bulge portion 212, the female die 220 includes a recess portion 221, and the recess portion 221 includes a second depressed portion 222. When the first male die 210 is completely embedded into the female die 220, the second bulge portion 212 is matched with the second depressed portion 222, the upper surface layer 110 of the cup 100 is formed through the first male die 210 and the female die 220, and the inner concave portion 140 is formed on the upper surface layer 110.

The mold 200 of the cup further includes a second male die 230, and the second male die 230 includes a second protruding portion 231. When the second male die 230 is completely embedded into the female die 220, the second protruding portion 231 of the second male die 230 is matched with the recess portion 221 of the female die 220. During hot pressing, the upper surface layer 110 of the cup 100 is formed through the first male die 210 and the female die 220, then the upper surface layer 110 is continuously placed on the female die 220, and the nipple-exposure prevention layer 130 of the cup 100 is placed in the inner concave portion 140 of the upper surface layer 110. During hot pressing, the second male die 230 is pressed on the lower surface layer 120, the nipple-exposure prevention layer 130 and the upper surface layer 110, thus forming the cup 100. After hot pressing, a first cavity is formed between the lower surface layer 120 and the nipple-exposure prevention layer 130.

In an embodiment, the mold 200 of the cup further includes a third male die 240, and the third male die 240 includes a third protruding portion 241. When the third protruding portion 241 is completely embedded into the female die 220, a third bulge portion 242 is matched with the second depressed portion 222. During hot pressing, the upper surface layer 110 of the cup 100 is formed through the first male die 210 and the female die 220 first, then the upper surface layer 110 is continuously placed on the female die 220, and the nipple-exposure prevention layer 130 of the cup 100 is placed in the inner concave portion 140 of the upper surface layer 110. During hot pressing, the third male die 240 is pressed on the lower surface layer 120, the nipple-exposure prevention layer 130 and the upper surface layer 110, thus forming the cup 100. Since the third male die 240 is provided with the third bulge portion 242, the outer convex portion 150 will be formed on the lower surface layer 120 of the cup 100 through the third bulge portion 242 during hot pressing, and a radian of the outer convex portion 150 is determined by a radian of the third bulge portion 242.

Therefore, in some implementations, the radian of the third bulge portion 242 may be set to be greater than that of the nipple-exposure prevention layer 130. By this setting, after the nipple-exposure prevention layer 130 and the lower surface layer 120 are hot-pressed, a second cavity 160 is formed between the nipple-exposure prevention layer 130 and the outer convex portion 150.

The radian of the third bulge portion 242 may be set to be not greater than that of the nipple-exposure prevention layer 130. By this setting, the radian of the outer convex portion 150 is not greater than that of the nipple-exposure prevention layer 130, and after the nipple-exposure prevention layer 130 and the lower surface layer 120 are hot-pressed, the surface of the nipple-exposure prevention layer 130 is closely attached to the surface of the outer convex portion 150.

In an embodiment, the nipple-exposure prevention layer 130 may be manufactured through a mold in advance, and the nipple-exposure prevention layer 130 includes a first extension second 131 and a second extension section 132. During hot pressing, the upper surface layer 110 of the cup 100 is formed through the first male die 210 and the female die 220 first, then the upper surface layer 110 is continuously placed on the female die 220, and the nipple-exposure prevention layer 130 of the cup 100 is placed in the inner concave portion 140 of the upper surface layer 110. The first extension section 131 and the second extension section 132 are overlapped on the upper surface layer 110. During hot pressing, the second male die 230 or the third male die 240 is pressed on the lower surface layer 120, the nipple-exposure prevention layer 130 and the upper surface layer 110, thus forming the cup 100.

In an embodiment, after the upper surface layer 110 is manufactured, adhesives may be coated on corresponding places of the upper surface layer 110 and/or the nipple-exposure prevention layer 130, so as to adhere the nipple-exposure prevention layer 130 to the upper surface layer 110, thus preventing the nipple-exposure prevention layer 130 from shifting during hot pressing.

In an embodiment, a first groove and a second groove may be formed on the upper surface layer 110 through the mold 200 or other tools. The first extension section 131 and the second extension section 132 of the nipple-exposure prevention layer 130 are respectively arranged in the first groove and the second groove, and the second male die 230 or the third male die 240 is pressed on the lower surface layer 120, the nipple-exposure prevention layer 130 and the upper surface layer 110, thus forming the cup 100.

In an embodiment, the first male die 210, the second male die 230, the third male die 240 and/or the female die 220 in the mold 200 of the cup is/are provided with a notch 260 at a respective edge thereof. When the first male die 210 and the female die 220 are both provided with a notch 260 at a respective edge thereof, the two notches 260 jointly form a groove, which is used for providing a hole position, so as to avoid compression of parts other than the cup 100, and reduce resistance during molding of the lower surface layer at the same time.

Figure 12:
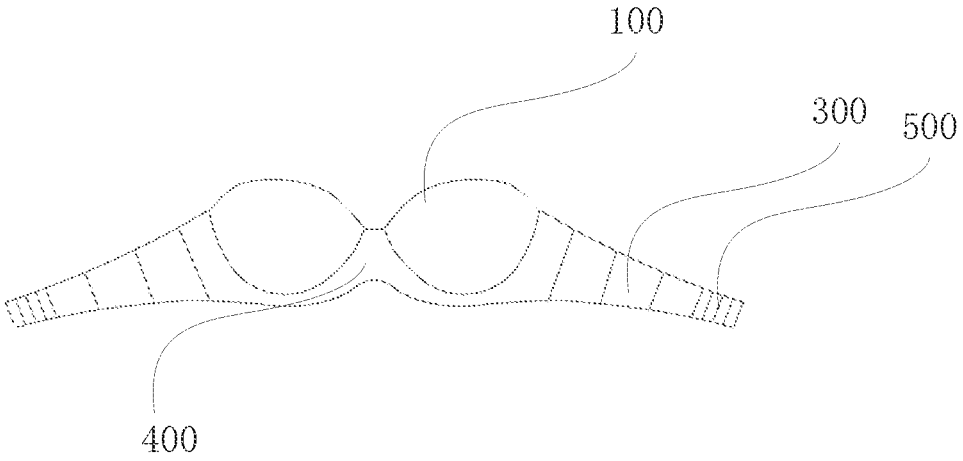
FIG. 12 is a schematic structural diagram of an underwear in an embodiment of the present application.

With reference to FIG. 12, an underwear in a third embodiment of the present application is described hereinafter.

The underwear includes two symmetrical cups 100 as described above, and the specific structure of the cup 100 is the same as that of the cup 100 in the first embodiment, which is not repeated herein.

The underwear further includes a side wing 300, a center front 400 and a back wing 500. The side wing 300 is connected with a side edge of the cup 100, the back wing 500 is connected with an edge of the side wing 300, and the center front 400 is arranged between the two cups 100. By arranging the above cups 100 on the underwear, nipple-exposure can be prevented when a female wear the thin and comfortable underwear.

The foregoing describes some implementations of the present application in detail, but the present application is not limited to the above implementations. Those of ordinary skills in the art may further make various equivalent modifications or substitutions without violating the gist of the present application, and these equivalent modifications or substitutions are included in the scope defined by the claims of the present application.

The invention claimed is:

1. A cup, comprising an upper surface layer, a lower surface layer and a nipple-exposure prevention layer, wherein, the upper surface layer is provided with an inner concave portion, the nipple-exposure prevention layer is arranged in the inner concave portion, and the upper surface layer is arranged towards a side farthest away from a breast; and when the lower surface layer is closely attached to the upper surface layer, and the lower surface layer is configured for contact with a wearer's human body nipple, the nipple-exposure prevention layer is capable of preventing the nipple from exposure.

2. The cup of claim 1, wherein after the lower surface layer and the upper surface layer are hot-pressed, a first cavity is formed between the lower surface layer and the nipple-exposure prevention layer.

3. The cup of claim 1, wherein the lower surface layer is provided with an outer convex portion protruding in a direction towards the nipple-exposure prevention layer; and a radian of the outer convex portion is greater than a radian of the nipple-exposure prevention layer, and after the nipple-exposure prevention layer and the lower surface layer are hot-pressed, a second cavity is formed between the nipple-exposure prevention layer and the outer convex portion.

4. The cup of claim 1, wherein the lower surface layer is provided with an outer convex portion protruding in a direction towards the nipple-exposure prevention layer; and a radian of the outer convex portion is not greater than a radian of the nipple-exposure prevention layer, and after the nipple-exposure prevention layer and the lower surface layer are hot-pressed, a surface of the nipple-exposure prevention layer is closely attached to a surface of the outer convex portion.

5. The cup of claim 1, wherein the nipple-exposure prevention layer comprises a first extension section and a second extension section, and the first extension section and the second extension section are closely attached to the upper surface layer respectively; and a third cavity is formed between the upper surface layer and the nipple-exposure prevention layer.

6. The cup of claim 5, wherein adhesives are arranged between the first extension section and the upper surface layer and between the second extension section and the upper surface layer, and the first extension section and the second extension section are adhered to the upper surface layer through the adhesives.

7. The cup of claim 5, wherein the upper surface layer is provided with a first groove and a second groove, and the first extension section and the second extension section are arranged in the first groove and the second groove respectively.

8. The cup of claim 1, wherein a surface of the nipple-exposure prevention layer is closely attached to the inner concave portion, the inner concave portion is provided with a first bulge portion, and the nipple-exposure prevention layer is provided with a first depressed portion corresponding to the first bulge portion.

9. The cup of claim 1, wherein the nipple-exposure prevention layer is a capsule filled with gas or liquid.

10. The cup of claim 1, wherein the nipple-exposure prevention layer is a nipple sticker composed of at least one of superfine fiber cotton, soft sponge, thermoplastic polyurethane elastomer rubber, thermoplastic rubber, polyamide, silicone plastic or rubber-plastic foaming material.

11. The cup of claim 10, wherein the nipple sticker has at least one layer.

12. The cup of claim 11, wherein the nipple sticker has three layers, comprising an outer layer, a middle layer and an inner layer, the outer layer is made of a superfine absorbent knitted fabric, the middle layer is made of the superfine fiber cotton or the soft sponge, and the inner layer is made of the superfine absorbent knitted fabric.

* * * * *